US006660105B1

(12) United States Patent
Ochi et al.

(10) Patent No.: US 6,660,105 B1
(45) Date of Patent: Dec. 9, 2003

(54) CASE HARDENED STEEL EXCELLENT IN THE PREVENTION OF COARSENING OF PARTICLES DURING CARBURIZING THEREOF, METHOD OF MANUFACTURING THE SAME, AND RAW SHAPED MATERIAL FOR CARBURIZED PARTS

(75) Inventors: Tatsuro Ochi, Muroran (JP); Manabu Kubota, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/269,118

(22) PCT Filed: Jul. 22, 1998

(86) PCT No.: PCT/JP98/03276

§ 371 (c)(1),
(2), (4) Date: May 19, 1999

(87) PCT Pub. No.: WO99/05333

PCT Pub. Date: Feb. 4, 1999

(30) Foreign Application Priority Data

Jul. 22, 1997 (JP) ..... 9-210222

(51) Int. Cl.[7] ..... C22C 38/12; C21D 8/00

(52) U.S. Cl. ..... 148/320; 148/654; 420/120; 420/127; 420/128

(58) Field of Search ..... 148/654, 320; 420/128, 120, 127

(56) References Cited

U.S. PATENT DOCUMENTS

| | | | | |
|---|---|---|---|---|
| 4,634,573 A | * | 1/1987 | Yanagiya et al. | 420/127 |
| 5,743,972 A | * | 4/1998 | Kimura et al. | 148/330 |
| 6,312,529 B1 | * | 11/2001 | Leap et al. | 148/226 |

FOREIGN PATENT DOCUMENTS

| | | | |
|---|---|---|---|
| JP | 63-76815 | | 4/1988 |
| JP | 01-176031 | * | 7/1989 |
| JP | 2-125841 | | 5/1990 |
| JP | 2-149643 | | 6/1990 |
| JP | 3-100142 | | 4/1991 |
| JP | 4-143253 | | 5/1992 |
| JP | 4-247848 | | 9/1992 |
| JP | 04-263012 | * | 9/1992 |
| JP | 05-125437 | * | 5/1993 |
| JP | 5-125437 | | 5/1993 |
| JP | 5-171347 | | 7/1993 |
| JP | 05-271753 | * | 10/1993 |
| JP | 5-279796 | | 10/1993 |
| JP | 6-17224 | | 1/1994 |
| JP | 6-17225 | | 1/1994 |
| JP | 6-60345 | | 8/1994 |
| JP | 8-199303 | | 8/1996 |

OTHER PUBLICATIONS

Office Action, Japanese Patent Office in Japanese Patent Application No. 11–509660 mailed Sep. 3, 2002 with English translation.

* cited by examiner

*Primary Examiner*—George Wyszomierski
*Assistant Examiner*—Janelle Combs Morillo
(74) *Attorney, Agent, or Firm*—Kenyon & Kenyon

(57) ABSTRACT

A case hardening steel having good-grain coarsening prevention properties during carburization. The steel comprises, by weight, 0.1 to 0.4%. C, 0.02 to 1.3% Si, 0.3 to 1.8% Mn, 0.001 to 0.15% S, 0.015 to 0.04% Al, 0.005 to 0.04% Nb, 0.006 to 0.020% N, one, two or more selected from 0.4 to 1.8% Cr, 0.02 to 1.0% Mo, 0.1 to 3.5% Ni, 0.03 to 0.5% V, and in which P is limited to not more than 0.025%, Ti is limited to not more than 0.010%, and O is limited to not more than 0.0025%, with the balance being iron and unavoidable impurities, the steel being characterized in that, following hot rolling, the steel has a Nb(CN) precipitation amount of not less than 0.005% and an AlN precipitation amount that. is limited to not more than 0.005%.

9 Claims, 4 Drawing Sheets

CASE HARDENED STEEL EXCELLENT IN THE PREVENTION OF COARSENING OF PARTICLES DURING CARBURIZING THEREOF, METHOD OF MANUFACTURING THE SAME, AND RAW SHAPED MATERIAL FOR CARBURIZED PARTS

TECHNICAL FIELD

This invention relates to a case hardening steel having good grain coarsening properties during carburization, to a method for producing the steel, and to a blank material for carburized parts.

BACKGROUND ART

Gear-wheels, bearing parts, rolling parts, shafts. and constant velocity joint parts are normally manufactured by a process using medium-carbon steel alloy for mechanical structures prescribed by, for example, JIS G 4052, JIS G 4104, JIS G 4105 and JIS G 4106 that is cold forged (including form rolling), machined to a specified shape and carburization hardened. Because cold forging produces a good product surface layer and dimensional precision, and results in a better yield, with a lower manufacturing cost, than hot forging, there is an increasing trend for parts that were conventionally produced by hot forging to be produced by cold forging which, in recent years, has produced a pronounced increase in the focus on carburized parts manufactured by the cold forging—carburizing process. A major problem with carburized parts is reducing heat treatment strain. This is because a shaft that warps as a result of strain from heat treatment can no longer function as a shaft, or in the case of gear-wheels or constant-velocity joint parts, high strain from heat treatment can cause noise and vibration. The major factor in such heat-treatment induced strain is grain coarsening produced during the carburizing. In the prior art, grain coarsening has been suppressed by annealing after cold forging and before carburization hardening. With respect to this, in recent years there is a strong trend toward omitting the annealing as a way of reducing costs. Therefore, there has been a strong need for steel in which grain coarsening does not occur even if the annealing is omitted.

Bearing and rolling parts that have to take a high contact stress are subjected to deep carburization. As deep carburization requires an extended period of time ranging from ten-plus hours to several tens of hours, it gives rise to another important issue, that of reducing the carburization time for the purpose of saving energy. One effective way of reducing the carburization time is to use a higher carburizing temperature. Carburization is normally performed at around 930° C. The problem with performing carburization at a higher temperature, in the range of 990 to 1090° C., is that it results in grain coarsening and a lack of the necessary material qualities, such as rolling fatigue characteristics and the like. Thus, there is a demand for case hardening steel that is suitable for high-temperature carburizing, that is, the grains of which are not coarsened by high-temperature carburizing. Many of the bearing and rolling parts that have to take a high contact stress are large parts that are normally manufactured by the steps of hot forging bar steel, heat treatment such as normalizing or the like, if required, machining, carburization hardening, and, if required, polishing. To suppress grain coarsening during carburizing, following the hot forging step, that is, when the parts are still blanks, it is necessary to optimize a material for suppressing the grain coarsening.

For this, JP-A-56-75551 discloses steel for carburizing comprising steel containing specific amounts of Al and N that is heated to not less than 1200° C. and then hot worked, whereby even after it has been carburized at 980° C. for six hours it is able to maintain fine grains, with the core austenite grains being fine grains having a grain size number of not less than six. However, the grain coarsening suppression ability of the steel is not stable and, depending on the process used to produce the steel, the steel may be unable to prevent grain coarsening during carburizing.

JP-A-61-261427 discloses a method of manufacturing steel for carburizing in which steel is used that contains specific amounts of Al and N, wherein after the steel has been heated to a temperature corresponding to the amounts of Al and N, then hot rolled at a finishing. temperature of not more than 950° C., the precipitation amount of AlN is not more than 40 ppm and the ferrite grain size number is from 11 to 9. Again, however, the grain coarsening suppression ability of the steel is not stable and, depending on the process used to produce the steel, the steel may be unable to prevent grain coarsening during carburizing.

JP-A-58-45354 discloses a case hardening steel containing specified amounts of Al, Nb and N. Again, however, the ability of the steel to suppress grain coarsening is not stable, so that in some cases grain coarsening is suppressed, and in other cases it is not. Moreover, in the examples the steel is described as having a nitrogen content of not less than 0.021%. If anything, that would have the effect of worsening the grain coarsening properties, making the steel susceptible to cracking and blemishes during the production process, in addition to which, because of the hardness, the material would have poor cold workability.

Thus, the above methods are not able to stably. suppress grain coarsening during carburization hardening, and therefore are not able to prevent strain and warping. With respect also to bearing and rolling parts that are subjected to high contact stresses, there are no examples in which such parts that have been subjected to deep carburizing by carburizing at a high temperature exhibit adequate strength properties. That is, there are no prior examples of blank materials for carburized parts or case hardening steel suitable for high-temperature carburization.

DISCLOSURE OF THE INVENTION

An object of the present invention is to provide case hardening steel with low heat-treatment strain having good grain coarsening prevention properties during carburization, a method of producing the steel, and, with respect to the production of carburized parts produced in the hot forging process, blank material for carburized parts that are able to prevent grain coarsening even during high-temperature carburizing and have adequate strength properties.

To attain the above object, the present inventors investigated what the dominant factors in grain coarsening were, and clarified the following points.

1. Even though steels may have the same chemical composition, in some cases they may be able to suppress grain coarsening and in other cases they may not be able to: grain coarsening cannot be prevented just by limiting the chemical composition. An important factor, apart from the chemical composition, is the state of precipitation of carbonitrides after the steel has been hot rolled or hot forged.

2. A key to preventing grain coarsening during carburization is, during carburization heating, to effect dispersion of a large amount of fine AlN and Nb(CN) as pinning particles.

3. To ensure a stable manifestation of the pinning effect of the Nb(CN) during carburization heating, the hot rolled or hot forged steel needs a prior fine precipitation of at least a given amount of Nb(CN). Moreover, if coarse AlN is precipitated or TiN or $Al_2O_3$ is present in the steel after the steel has been hot rolled or hot forged, it will form coarse Nb(CN) precipitation nuclei, impeding the fine precipitation of the Nb(CN). This being the case, it is necessary to keep the Ti content and O content as low as possible.

4. To ensure a stable manifestation of the pinning effect of the AlN during carburization heating, in contrast to Nb(CN), it is necessary to minimize the AlN precipitation amount in the steel in the hot rolled or hot forged condition. This is an essential requirement for achieving fine precipitation of the Nb(CN). Moreover, any TiN or $Al_2O_3$ that is present in the steel after the steel has been hot rolled or hot forged will form AlN precipitation nuclei, increasing the amount of AlN precipitation, so in this case, too, the Ti and O contents have to be minimized.

5. Even if carbonitrides are controlled as described, any admixture of bainitic structure in the steel after hot rolling will promote grain coarsening during carburization heating.

6. Moreover, grain coarsening will occur more readily during carburization heating if the ferrite grains in the steel following hot rolling are excessively fine.

7. In order to minimize the AlN precipitation amount in the steel in the hot rolled condition, the steel has to be heated to a high temperature for the hot rolling.

8. Prior fine precipitation of at least a given amount of Nb(CN) in the steel that has been hot rolled can be ensured by optimizing the hot rolling temperature and the cooling conditions used after the hot rolling. That is, the Nb(CN) is occluded in the matrix by heating the steel to a high temperature for the hot rolling, and after the steel has been hot rolled, the Nb(CN) can be finely dispersed in large amounts by cooling slowly in the Nb(CN) precipitation temperature region.

The present invention was achieved based on the above novel findings. The gist of the present invention is as follows.

The invention of claims 1 to 4 is, a case hardening steel having good grain coarsening prevention properties during carburization characterized in that said steel comprises, in mass%, 0.1 to 0.4% C, 0.02 to 1.3% Si, 0.3 to 1.8% Mn, 0.001 to 0.15% S, 0.015 to 0.04% Al, 0.005 to 0.04% Nb, 0.006 to 0.020% N, one, two or more selected from 0.4 to 1.8% Cr, 0.02 to 1.0% Mo, 0.1 to 3.5% Ni, 0.03 to 0.5% V, and in which P is limited to not more than 0.025%, Ti is limited to not more than 0.010%, and O is limited to not more than 0.0025%, with the balance being iron and unavoidable impurities, the steel, following hot rolling, having a Nb(CN) precipitation amount of not less than 0.005% and an AlN precipitation amount that is limited to not more than 0.005%, and that also, following hot rolling, the matrix of the steel contains not less than 20 particles/100 $\mu m^2$ of Nb(CN) of a particle diameter of not more than 0.1 $\mu$m, and that also, following hot rolling, the bainite structure fraction of the steel is limited to not more than 30%, and that also, following hot rolling, the steel has a ferrite grain size number of from 8 to 11.

The invention of claims 5 to 7 is, a method of producing the above steel characterized in that the steel is heated to a temperature of not less than 1150° C., maintained at that temperature for not less than 10 minutes, and hot rolled to form wire or bar steel, and that also, after the steel is hot rolled the steel is slowly cooled between 800 and 500° C. at a cooling rate of not more than 1° C./s, and that also, the steel is hot rolled at a finishing temperature of 920 to 1000° C.

The invention of claims 8 and 9 is, a steel blank material for carburized parts having good grain coarsening prevention properties during carburization characterized in that said blank material comprises, by mass, 0.1 to 0.40% C, 0.02 to 1.3% Si, 0.3 to 1.8% Mn, 0.001 to 0.15% S, 0.015 to 0.04% Al, 0.005 to 0.04% Nb, 0.006 to 0.020% N, one, two or more selected from 0.4 to 1.8% Cr, 0.02 to 1.0% Mo, 0.1 to 3.5% Ni, 0.03 to 0.5% v, and in which P is limited to not more than 0.025%, Ti is limited to not more than 0.010%, and O is limited to not more than 0.0025%, with the balance being iron and unavoidable impurities, the steel blank material, following hot forging, having a Nb(CN) precipitation amount of not less than 0.005% and an AlN precipitation amount that is limited to not more than 0.005%, and also that, following hot forging, the matrix of the steel contains not less than 20 particles/100 $\mu m^2$ of Nb(CN) of a particle diameter of not more than 0.1 $\mu$m.

BEST MODE FOR CARRYING OUT THE INVENTION

Figure 1:
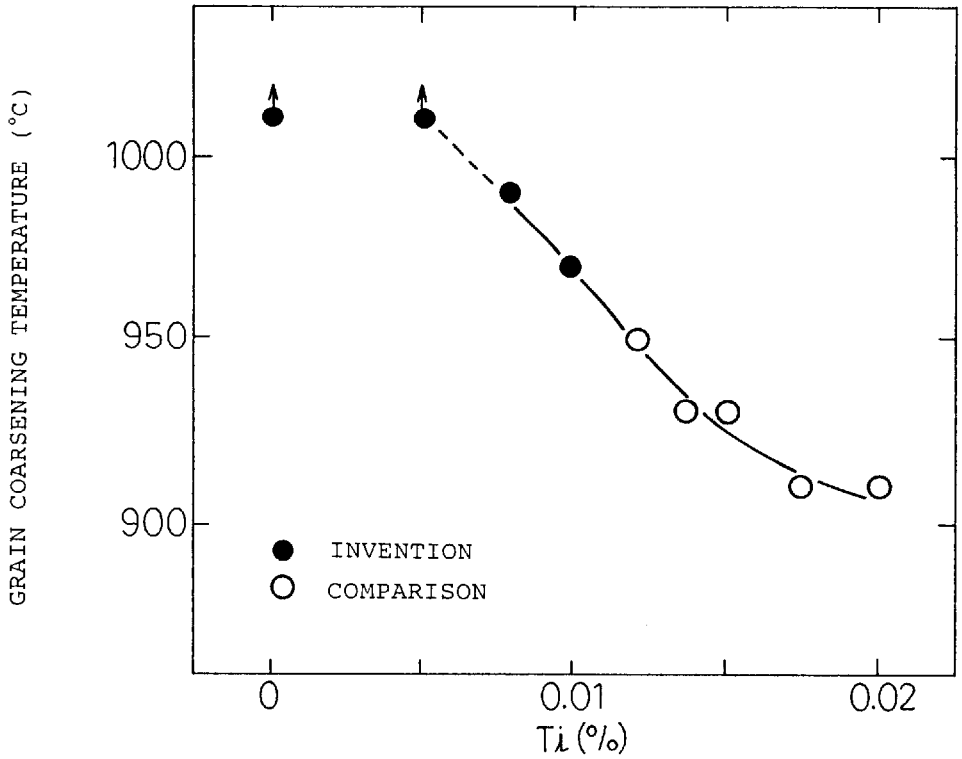
FIG. 1 is a diagram of an example of an analysis of the relationship between Ti amount and the grain coarsening temperature.

Details of the present invention will now be described, starting with the reasons for the defined component limitations.

C is an effective element for giving the steel the necessary strength. However, the necessary tensile strength is not obtained if the amount of C is less than 0.1%, while an amount that exceeds 0.40% makes the steel hard, degrading its cold workability, and the core toughness following carburization is also degraded. Therefore it is necessary to set the range to 0.1 to 0.40%. The preferred range is 0.1 to 0.35.

Si is an effective element for deoxidization of the steel, and is also effective for giving the steel the necessary strength and hardenability and improving the resistance to temper softening. The effect will not be adequate if the Si content is less than 0.02%, while more than 1.3% Si tends to increase the hardness, degrading the cold forgeability. It is therefore necessary to specify a content range of 0.02 to 1.3%. For steel that is to be cold worked, the preferred range is 0.02 to 0.5%, and more preferably 0.02 to 0.3%. When the emphasis is on cold forgeability, a range of 0.02 to 0.15% is desirable.

Also, Si is an effective element for increasing the grain boundary strength, and is effective for imparting a long service life to bearing and rolling parts by suppressing structural changes and degradation of materials arising in the course of rolling fatigue. For hot forged parts in which the emphasis is on high strength, a preferred Si content range is 0.2 to 1.3%. To obtain a particularly high rolling fatigue strength, it is desirable to use a range of 0.4 to 1.3%. The effect that added Si has in imparting a long service life to bearing and rolling parts by suppressing structural changes and degradation of materials arising in the course of rolling fatigue is particularly pronounced when the retained austenite (usually referred to as "retained γ") in the structure following carburization is around 30 to 40%. Carbonitriding is effective for controlling the amount of retained γ within this range. Suitable conditions to use are those resulting in a surface nitrogen concentration of 0.2 to 0.6%. In this case, during carburization, it is desirable to use a carbon potential of 0.9 to 1.3%.

Mn is an effective element for deoxidization of the steel, and is also effective for giving the steel the necessary strength and hardenability. The effect will not be adequate if the Mn content is less than 0.3%, while more than 1.8% Mn will have a saturation effect and will also increase the hardness, degrading the cold forgeability. It is therefore necessary to specify a content range of 0.3 to 1.8%, and preferably 0.5 to 1.2%. When the emphasis is on cold workability, a range of 0.5 to 0.75% is desirable.

S forms MnS in the steel, and is added to achieve the improvement in machinability that MnS imparts. The effect will not be adequate if the S content is less than 0.001%. However, more than 0.15% will have a saturation effect, giving rise to segregation at grain boundaries and grain boundary embrittlement. It is therefore necessary to specify a content range of 0.001 to 0.15%; preferably 0.005 to 0.15%, and more preferably 0.005 to 0.04%. Because MnS degrades the rolling fatigue life of bearing and rolling parts, and therefore has to be minimized in steel for such applications, in such a case it is desirable to use a content range of 0.001 to 0.01%.

During carburization heating Al bonds with N in the steel to form AlN, refining the grains, and it is also effective for suppressing grain coarsening. The effect will not be adequate if the Al content is less than 0.015%. However, more than 0.04%. will coarsen AlN precipitates, making the Al unable to contribute to suppression of grain coarsening. The content range therefore is set at 0.015 to 0.04%, and preferably at 0.02 to 0.035%.

During carburization heating Nb bonds with C and N in the steel to form Nb(C, N), refining the grains, and it is also effective for suppressing grain coarsening. The effect will not be adequate if the Nb content is less than 0.005%. However, more than 0.04% will harden the steel, degrading the cold workability, and coarsen Nb(C, N) precipitates, making the Nb unable to contribute to suppression of grain coarsening. The content range therefore is set at 0.005 to 0.04%, and preferably at 0.01 to 0.03%. Also, in the steel and blank material for carburized parts of this invention, the invasion of carbon and nitrogen during the carburization heating reacts with the solid solution Nb, producing extensive precipitation of fine Nb(CN) in the carburized layer. In the case of bearing and rolling parts, this Nb(CN) contributes to improving the rolling fatigue life of such parts. When the intention is to achieve a very long rolling fatigue life for such parts, it is effective to use a carbon potential during the carburization that is set on the high side, from 0.9 to 1.3%, or to use carbonitriding. In carbonitriding nitriding takes place in the dispersion process following the carburizing. Suitable conditions to use are those resulting in a surface nitrogen concentration of 0.2 to 0.6%.

N is added to achieve the grain refinement during carburizing resulting from the precipitation of AlN and Nb(C, N) and for suppressing grain coarsening. The effect will not be adequate if the N content is less than 0.006%, while more than 0.020% will have a saturation effect. Adding too much N will increase the hardness of the steel, degrading the cold workability and the rolling fatigue properties of the final product. For these reasons the content range is set at 0.006 to 0.020%, and preferably at 0.009 to 0.020%.

Next, the reasons for the content limitations oh the one, two or more selected from Cr, Mo, Ni and V contained in the steel of the invention will be explained.

Cr is an effective element for imparting strength and hardenability to the steel. With respect to bearing and rolling parts, it also increases the amount of retained γ following carburizing and is effective for imparting a long service life to bearing and rolling parts by suppressing structural changes and degradation of materials arising during the course of rolling fatigue. The effect will not be adequate if the Cr content is less than 0.4%, while more than 1.8% Cr tends to increase the hardness, degrading the cold forgeability. For these reasons, it is necessary to set the content range at 0.4 to 1.8%, preferably 0.7 to 1.6%, and more preferably 0.7 to 1.5%. The effect that added Cr has in imparting a long service life to bearing and rolling parts by suppressing structural changes and degradation of materials arising in the course of rolling fatigue is particularly pronounced when the amount of retained γ in the structure following carburization is around 25 to 40%. Carbonitriding is effective for controlling the amount of retained γ within this range. Suitable conditions to use are those resulting in a surface nitrogen concentration of 0.2 to 0.6%.

Mo is also an effective element for imparting strength and hardenability to the steel and, with respect to bearing and rolling parts it also increases the amount of retained γ following carburizing and is effective for imparting a long service life to bearing and rolling parts by suppressing structural changes and degradation of materials arising in the course of rolling fatigue. The effect will not be adequate if the Mo content is less than 0.02%, while more than 1.0% Mo tends to increase the hardness, degrading the cold forgeability. For these reasons, it is necessary to set the content range at 0.02 to 1.0%, preferably at 0.02 to 0.5%, and more preferably at 0.02 to 0.4%. As in the case of Cr, the effect that added Mo has in imparting a long service life to bearing and rolling parts by suppressing structural changes and degradation of materials arising in the course of rolling fatigue is particularly pronounced when the amount of retained γ in the structure following carburization is around 25 to 40%.

Ni is another element that is effective for imparting strength and hardenability to the steel. The effect will not be adequate if the Ni content is less than 0.1%, while more than 3.5% Mo tends to increase the hardness, degrading the cold forgeability. For these reasons, it is necessary to set the content range at 0.1 to 3.5%, and preferably at 0.4 to 2.0%.

V is another element that is effective for imparting strength and hardenability to the steel. The effect will not be adequate if the V content is less than 0.03%, while more than 0.5% V tends to increase the hardness, degrading the cold forgeability. For these reasons, it is necessary to set the content range at 0.03 to 0.5%, and preferably at 0.07 to 0.2%.

P degrades cold forgeability by raising deformation resistance during cold forging and degrading the toughness. It also results in grain boundary embrittlement in parts subjected to quench-hardening and tempering, degrading the fatigue strength, so it is therefore desirable to minimize the P content. For this reason, the content needs to be limited to not more than 0.025%, and preferably to not more than 0.015%.

In a high nitrogen steel such as the steel of this invention, Ti bonds with N in the steel to form TiN. TiN precipitates are coarse, and do not contribute to grain refinement during carburizing or to suppression of grain coarsening. In fact, when there is TiN present it forms AlN or Nb(CN) precipitation sites, so that during hot rolling the AlN and Nb(CN) precipitate as coarse particles that are unable to suppress grain coarsening during carburization. Because of this, it is desirable to minimize the Ti content. FIG. 1 is a diagram showing the relationship between the Ti amount and the grain coarsening temperature, based on the simulated carburization of steel subjected to cold upsetting at a reduction ratio of R=50% and maintained for five hours at each temperature. When the Ti content exceeds 0.010% the temperature at which grain coarsening occurs is not more than 950° C., making the generation of coarse grains a practical concern. It is therefore necessary to limit the Ti content to not more than 0.010%, and preferably to not more than 0.005%. In the case of bearing and roller parts the presence of coarse TiN can result in a pronounced degradation of the rolling fatigue properties of the final product, so when the steel is to be used for such parts, it is desirable to limit the Ti content to not more than 0.0025%.

Figure 2:
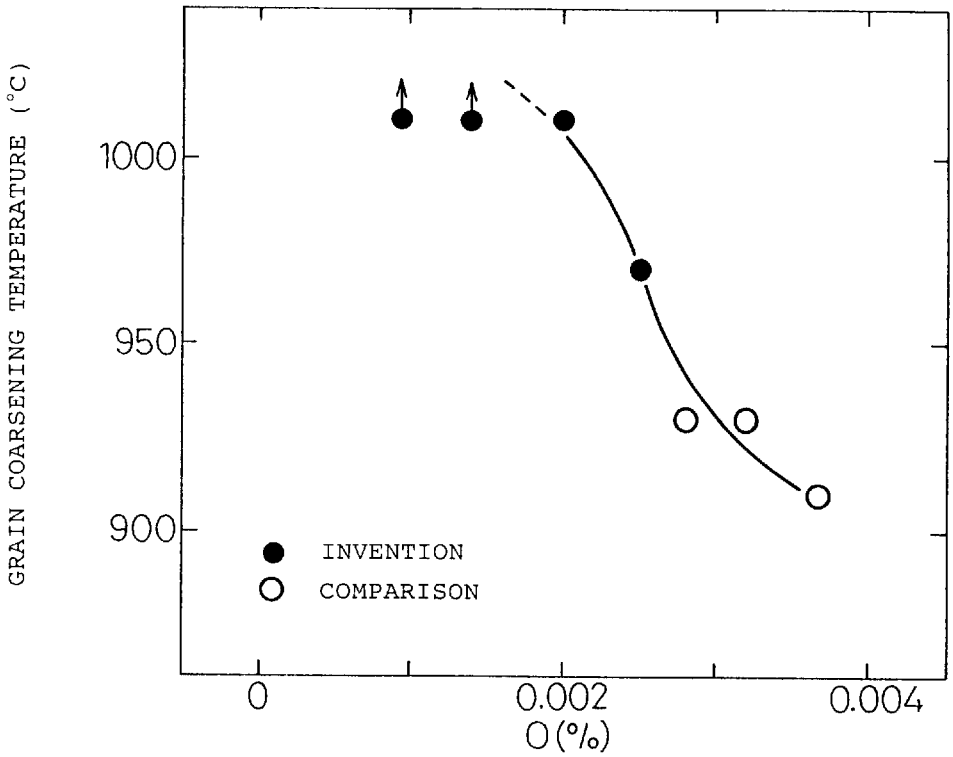
FIG. 2 is a diagram of an example of an analysis of the relationship between oxygen amount and the grain coarsening temperature.

In a high Al steel such as the steel of this invention, oxygen forms oxide inclusions such as $Al_2O_3$. In large amounts oxide inclusions form AlN and Nb(CN) precipitation sites. During the hot rolling the AlN and Nb(CN) precipitate as coarse particles and are therefore unable to suppress the grain coarsening during carburization. It is therefore desirable to minimize the oxygen content. FIG. 2 is a diagram of the relationship between oxygen content and the temperature at which grain coarsening occurs, based on the simulated carburization of steel subjected to cold upsetting at a reduction ratio of R=50% and maintained for five hours at each temperature. When the oxygen content exceeds 0.0025% the temperature at which grain coarsening occurs is less than 950° C., making the generation of coarse grains a practical concern. It is therefore necessary to limit the oxygen content to not more than 0.0025%, and preferably to not more than 0.002%. In bearing and roller parts oxide inclusions form points at which rolling fatigue failure starts, so the lower the oxygen content is, the longer the rolling life becomes. For this reason, in the case of such parts it is desirable to limit the oxygen content to not more than 0.0012%.

The reasons for specifying a Nb(CN) precipitation amount of not less than 0.005% following hot rolling or hot forging and limiting the AlN precipitation amount to not more than 0.005% in accordance with this invention will now be explained.

Dispersion of a large amount of fine grains of AlN and Nb(CN) during carburizing as pinning particles is an effective way of preventing grain coarsening during the carburizing. Coarse AlN and Nb(CN) is useless for preventing grain coarsening during carburization, and even has an adverse effect on grain coarsening prevention by decreasing the number of pinning particles. Nb associates with C and N in the steel to form NbC, NbN and a compound of both, Nb(CN). Herein, Nb(CN) is used as a collective term for the three types of precipitates.

Figure 3:
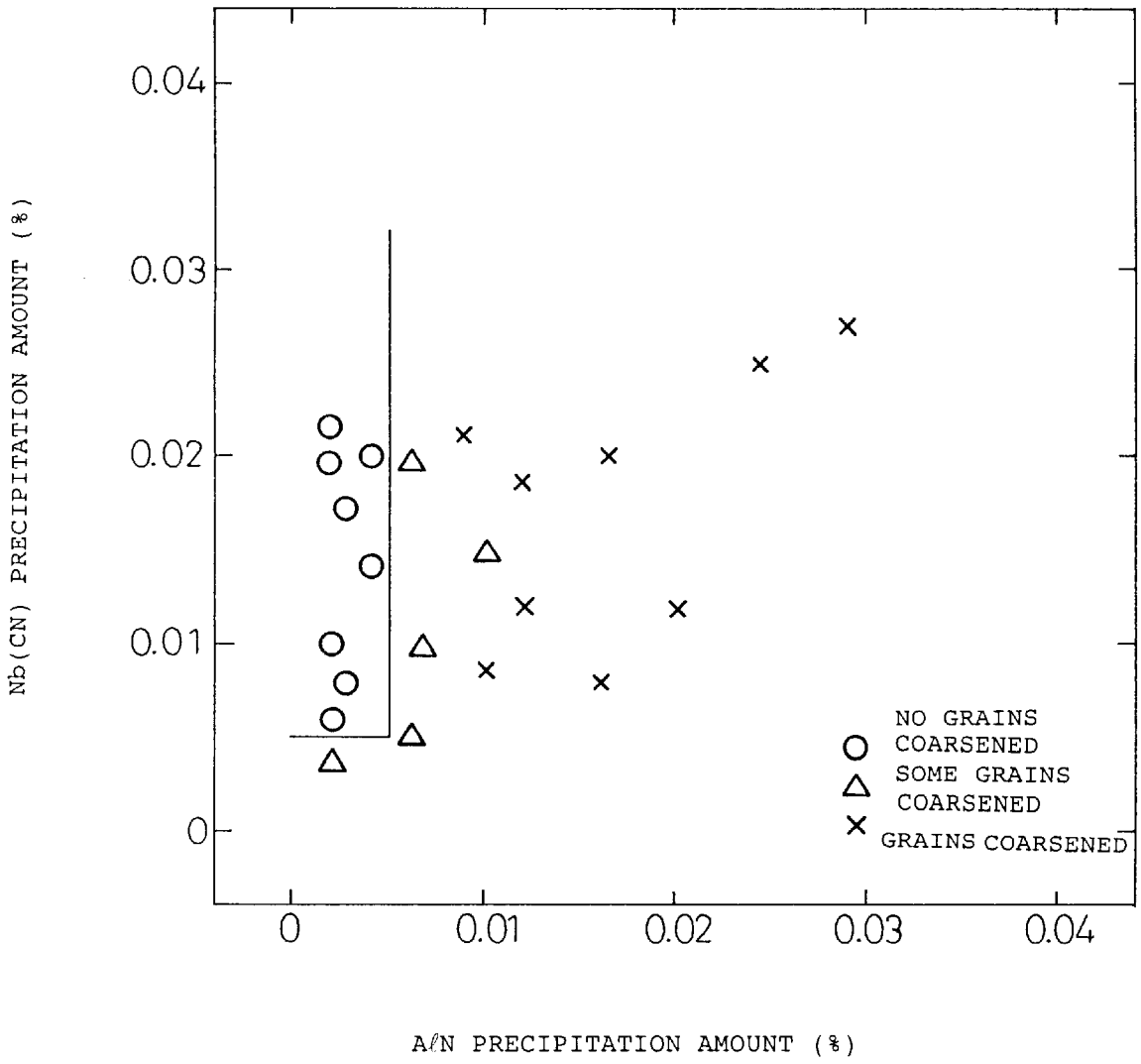
FIG. 3 is a diagram of an example of an analysis of the relationship between AlN precipitation amount and Nb(CN) precipitation amount after hot rolling and the grain coarsening temperature.

To achieve a stable pinning effect of the Nb(CN) during carburization heating, prior precipitation of at least a given amount of Nb(CN) in the hot rolled or hot forged steel is required. Also, to achieve a stable manifestation of the AlN pinning effect during carburization heating, the AlN precipitation amount in the steel in the hot rolled condition or hot forged condition has to be kept as low as possible. This is because AlN that precipitates in the steel as hot rolled or hot forged precipitates as coarse particles that not only do not act as pinning particles, but by forming nuclei of coarse precipitates of Nb(CN), promote grain coarsening by obstructing the fine precipitation of Nb(CN). FIG. 3 is a diagram of the relationship between AlN and Nb(CN) precipitation amounts in the steel after hot rolling and grain coarsening temperature, based on the simulated carburization of steel at 950° C. for five hours after the steel was subjected to cold upsetting at a reduction ratio of R=50% following spheroidization annealing. Coarse grains occur when the Nb(CN) precipitation amount is less than 0.005% and the AlN precipitation amount is more than 0.005%. Based on these results, Nb(CN) precipitation following hot rolling or hot forging has to be not less than 0.005%, and preferably not less than 0.01%, and AlN precipitation has to be limited to not more than 0.005%, and preferably to not more than 0.003%. Limiting the AlN precipitation amount in the as hot rolled or as hot forged steel to the level specified by this invention makes it possible to finely disperse AlN in the steel after the hot rolling or hot forging or during the carburization heating process, thereby enabling prevention of grain coarsening during the carburization. The AlN precipitation can be analyzed by a generaly-used method comprising dissolving it in a solution of bromide methanol and using a 0.2 μm filter to obtain a residue that is then chemically analyzed. The Nb(CN) precipitation can be analyzed by a generally-used method comprising dissolving it in hydrochloric acid and using a 0.2 μm filter to obtain a residue that is then chemically analyzed. With a 0.2 μm filter, it is actually possible to extract precipitates even finer than 0.2 μm, since in the filtration process the precipitates clog the filter.

Next, in the case of claim 2, claim 6 and claim 9 of the present invention, with respect to the steel of the invention containing added Nb, the matrix of the steel is defined as containing not less than 20 particles/100 $\mu m^2$ of Nb(CN) of a particle diameter of not more than 0.1 μm. The reason for the limitations will now be explained.

Figure 4:
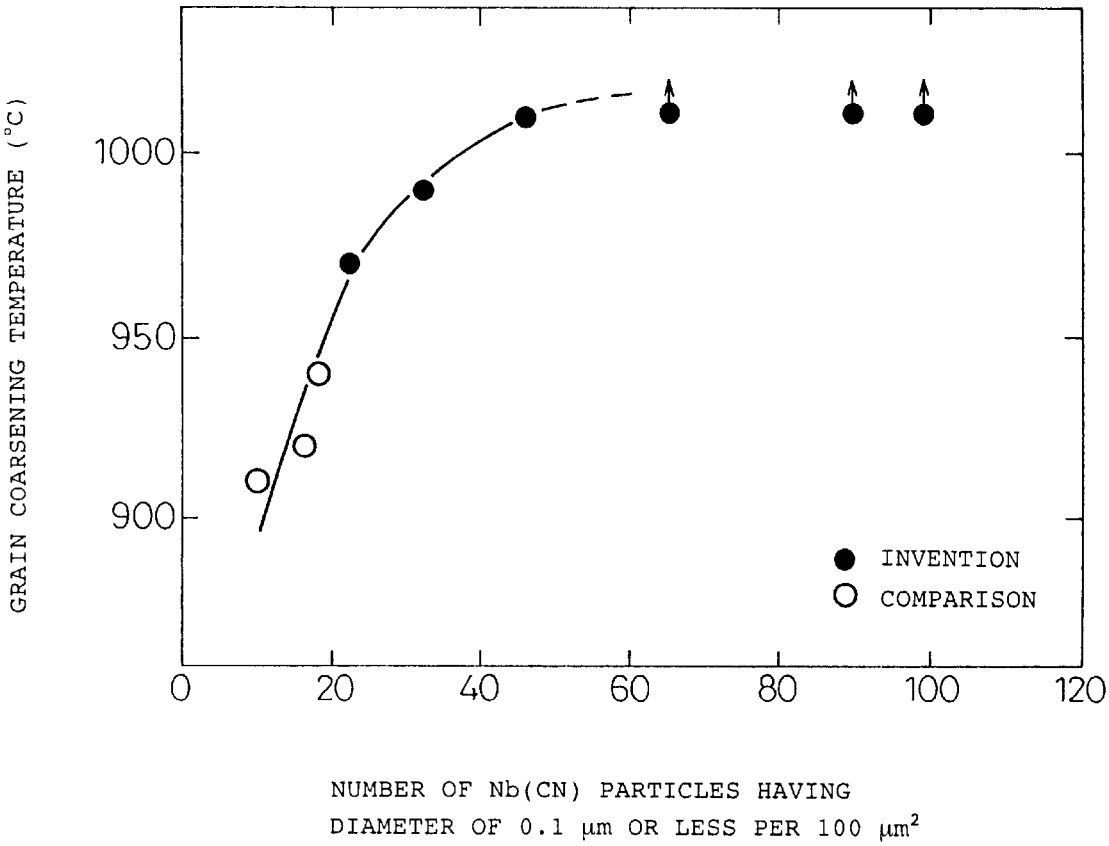
FIG. 4 is a diagram of an example of an analysis of the relationship between the number of fine grains of precipitates of Nb(CN) after hot rolling and the, grain coarsening temperature.

As described above, an effective way of suppressing grain coarsening is the extensive fine dispersion of grain boundary pinning particles. It is preferable for the particles to be of a small diameter and numerous, because the smaller and more numerous they are, the greater the number of pinning particles becomes. FIG. 4 is a diagram of the relationship between fine Nb(CN) and grain coarsening temperature, based on the simulated carburization of steel subjected to cold upsetting at a reduction ratio of R=50% and maintained for five hours at each temperature. FIG. 4 reveals that there is a very close relationship between grain coarsening characteristics and the number of fine precipitation particles following hot rolling. When not less than 20 particles/100 $\mu m^2$ of Nb(CN) of a particle diameter of not more than 0.1 μm are dispersed in the matrix, in practical terms grain coarsening does not occur in the carburization heating region, meaning that excellent grain coarsening prevention properties are obtained. Therefore it is necessary to disperse in the matrix not less than 20 particles/100 $\mu m^2$ of Nb(CN) of a particle diameter of not more than 0.1 μm, and preferably not less than 50 particles/100 $\mu m^2$. The dispersion state of the Nb(CN) can be ascertained by using the extraction replica method to obtain a sample of precipitates in the steel matrix, and using a transmission electron microscope to examine the sample at a magnification of 30,000× and counting the number of Nb(CN) particles in a 20 field of view having a diameter of not more than 0.1 μm, and converting them count to obtain the number per 100 $\mu m^2$.

Next, with respect to the invention of claims 3 and 6 in which the bainite structure fraction of the steel following hot rolling is limited to not more than 30%, the reason for the limitation will now be explained.

Figure 5:
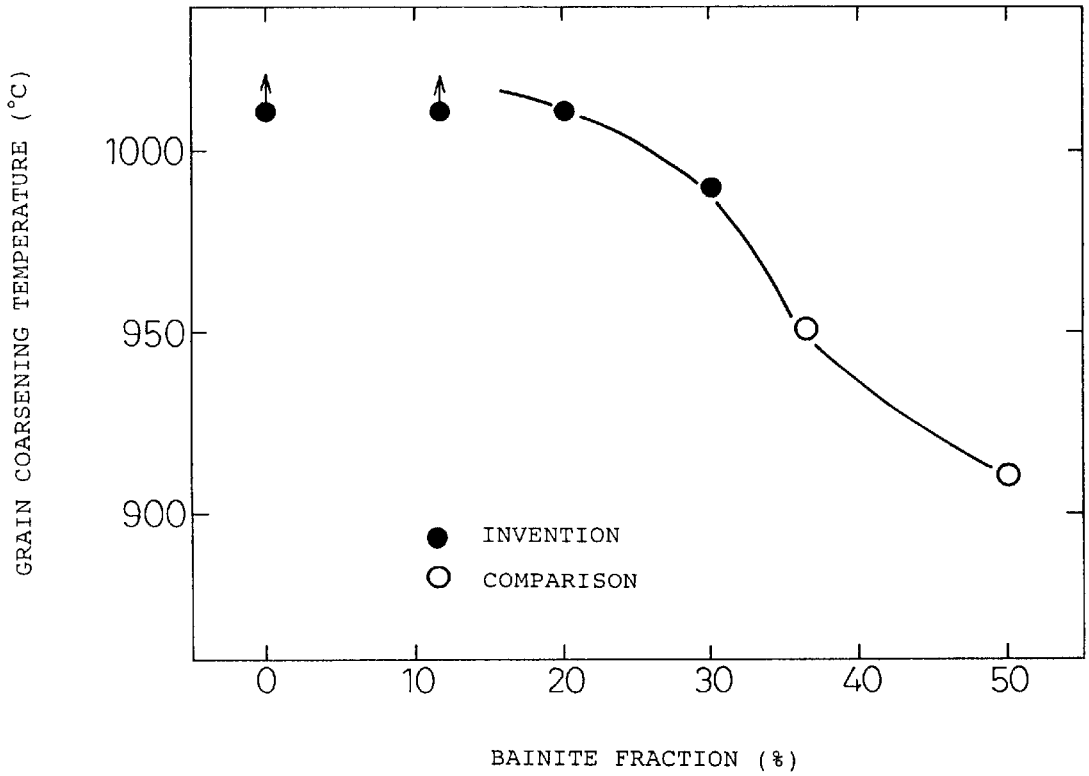
FIG. 5 is a diagram of an analysis of the relationship between the bainite structure fraction after hot rolling and the grain coarsening temperature.

Even when the AlN and Nb(CN) are regulated as described, any admixture of bainitic structure in the steel after hot rolling will cause grain coarsening during carburization heating. FIG. 5 is a diagram of the relationship between the bainite structure fraction and grain coarsening temperature, based on the simulated carburization of steel subjected to cold upsetting at a reduction ratio of R=50% and maintained for five hours at each temperature. When the bainite structure fraction exceeds 30% the grain coarsening temperature decreases to less than 950° C., making the generation of coarse grains a practical concern. It is also desirable to suppress the admixture of bainite from the standpoint of improving cold workability. For these reasons, it is necessary to limit the bainite structure fraction to not more than 30%, and preferably to not more than 20%. Moreover, in the case of parts produced by hot forging, if the hot forging temperature and the cooling rate are controlled to suppress the bainite structure fraction in the formed pieces to not more than 30%, the normalizing step after the hot forging can be omitted.

Next, with respect to the invention of claims 4 and 7 in which, following hot rolling, the steel has a ferrite grain size number of from 8 to 11, the reason for the limitation will now be explained.

Figure 6:
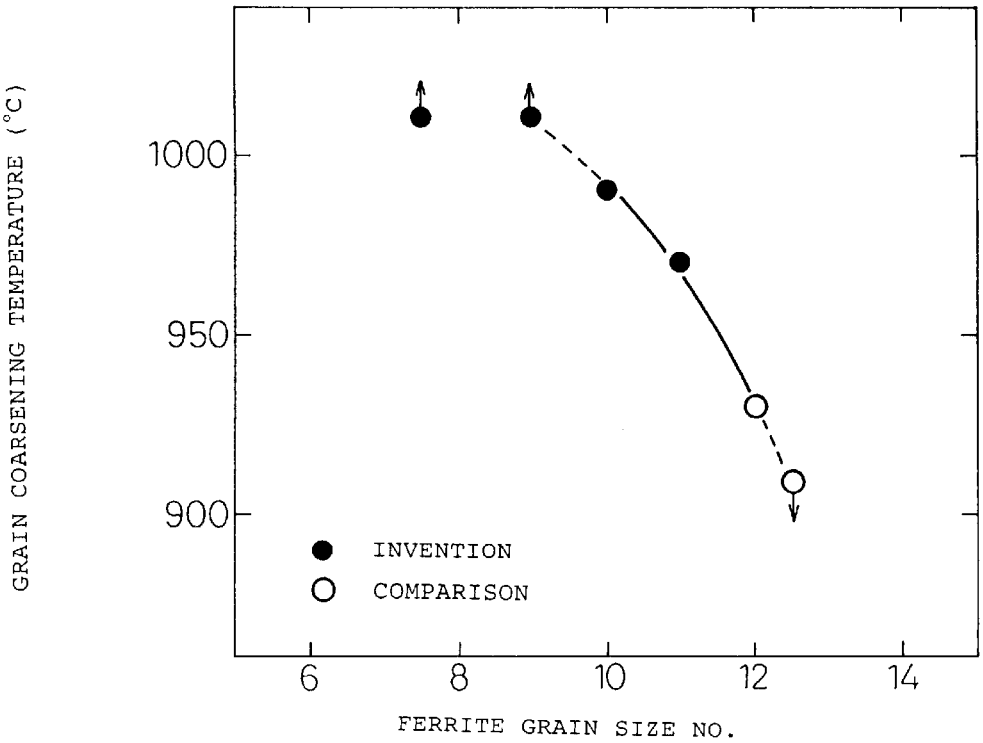
FIG. 6 is a diagram of an analysis of the relationship between ferrite grain size number after hot rolling and the grain coarsening temperature.

Grain coarsening will occur more readily during carburization heating if the ferrite grains in the steel following hot rolling are excessively fine. FIG. 6 is a diagram of the relationship between ferrite grain size number and grain coarsening temperature, based on the simulated carburization of steel subjected to cold upsetting at a reduction ratio of R=50% and maintained for five hours at each temperature. When the ferrite grain size number exceeds 11 the grain coarsening temperature is less than 950° C., making the generation of coarse grains a practical concern. Also, if a ferrite grain size number is used that is less than 8 after hot rolling, the hardness is increased, degrading the cold forgeability. For these reasons, following the hot rolling, it is necessary for the ferrite grain size number to be from 8 to 11.

Next, the hot rolling conditions will be described.

The steel having the above-described composition according to the present invention is melted and the composition adjusted by a normal method using a converter, electric furnace or the like. The steel is then cast, rolled into ingots, if required, and hot rolled to form steel wire or bar steel.

Next, in the invention of claim 5 the steel is heated to a temperature of not less than 1150° C., maintained at that temperature for not less than 10 minutes, and hot rolled to form wire or bar steel. If the steel is heated to less than 1150° C., or is heated to not less than 1150° C. but is maintained at the temperature for less than 10 minutes, it will not be possible to achieve the sufficient solution of the AlN or Nb(CN) in the matrix. The result will be that there will be no prior fine precipitation of at least a given amount of Nb(CN) in the hot rolled steel, and coarse AlN and Nb(CN) will be present in the steel after the hot rolling, making it impossible to suppress grain coarsening during carburization. Thus, it is necessary to maintain the steel at not less than 1150° C. for not less than 10 minutes at that temperature. Preferably, the steel should be maintained at not less than 1180° C. for not less than 10 minutes.

Next, in the invention of claim 6, after hot rolling, the steel is slowly cooled between 800 and 500° C. at a cooling rate of not more than 1° C./s. If the cooling rate exceeds 1° C./s the steel will not be in the Nb(CN) precipitation temperature region long enough to obtain a sufficient precipitation of fine NB(CN) in the steel following hot rolling, as a result of which it will be impossible to suppress the generation of coarse grains during carburization. A rapid cooling rate will also increase the hardness of the rolled steel, degrading the cold workability. Thus, it is desirable to cool the steel as slowly as possible. A preferred cooling rate is not more than 0.7° C./s. The cooling rate can be slowed by providing the downstream part of the rolling line with a heat insulation cover, or a heat insulation cover with a heat source.

In the invention of claim 7, the steel is hot rolled at a finishing temperature of 920 to 1000° C. If the finishing temperature is less than 920° C. the ferrite grains will be too fine, facilitating the generation of coarse grains during carburization. On the other hand, if the finishing temperature is more than 1000° C., it will increase the hardness of the steel, degrading the cold workability. For these reasons, a hot rolling finishing temperature of 920 to 1000° C. is specified.

The invention of claims 8 and 9 relates to blank material for carburized parts having good grain coarsening prevention properties during carburization. This embodiment relates to carburized parts and carbonitrided parts produced by the steps of hot forging bar steel, heat treatment such as normalizing or the like, if required, machining, carburization hardening, and, if required, polishing. The blank material of the invention refers to intermediate parts, that is, at the stage following the, hot forging. With the blank material for carburized parts having the excellent grain coarsening prevention properties during carburization according to this invention, the generation of coarse grains can be suppressed and excellent material properties obtained even when carburization hardening is carried out under extreme high-temperature conditions of 990° C. to 1090° C. For example, bearing and rolling parts can be subjected to high-temperature carburization and still exhibit excellent rolling fatigue characteristics. The reasons for the various limitations are the same as those described with reference to claims 1 and 2.

The invention imposes no particular limitations on the size of casts, solidification cooling rate, or ingot rolling conditions. Any conditions may be used that satisfy the requirements of the invention. Moreover, the present invention does not impose any particular limitation on carburization conditions. In the case of bearing and rolling parts, Nb(CN) contributes to improving the rolling fatigue life of such parts. When the intention is to achieve a very long rolling fatigue life for bearing and rolling parts, as mentioned above, it is effective to use a carbon potential during carburization that is on the high side, from 0.9 to 1.3%, or to use carbonitriding. In carbonitriding, the nitriding is effected in the dispersion process following the carburizing. Suitable conditions to use are those that provide a surface nitrogen concentration of 0.2 to 0.6%. Selecting these conditions will provide extensive precipitation of fine Nb(CN) in the carburized layer, and 25 to 40% retained γ will help to improve rolling life.

EXAMPLES

Examples of the effect of the invention will now be described with reference to specific embodiments.

Example 1

Steel melts having the compositions listed in Table 1 were prepared in a converter, continuously cast and, if necessary, rolled into ingots to form square rolled bars measuring 162 mm a side. These were then hot rolled to form round bars having a diameter of 23 to 25 mm. The hot rolling was performed at a temperature of 1080° C. to 1280° C., with a finishing temperature of 920° C. to 1000° C. After rolling, the steel was cooled from 800° C. to 500° C. at a rate of 0.2 to 1.5° C./s. The amounts of AlN precipitation and Nb(CN) precipitation in the hot rolled bars were obtained by chemical analysis. The Vickers hardness of the bars was also measured and used as an index of cold workability.

After the bars thus produced were subjected to spheroidization annealing, upset test specimens were prepared and upsetting implemented at a reduction ratio of 50%, after which a carburization simulation was run. Simulation conditions were heating at 910° C. to 1010° C. for five hours followed by water cooling. Following this, a cut surface of the samples was polished and etched to examine the prior austenite grain size and the grain coarsening temperature obtained. Carburization is usually performed at 930° C. to 950° C., so samples exhibiting a grain coarsening temperature of not more than 950° C. were judged to have inferior grain coarsening characteristics. The austenite grain size was measured based on the method of JIS G 0551. Thus, the samples were examined at a magnification of 400× in about 10 fields of view, and grain coarsening was deemed to have occurred if there was even one coarse particle with a particle size of up to No. 5.

Table 2 lists the results, together with the γ grain. size during carburization at 950° C. The grain coarsening temperature in the case of the steel of this invention was not less than 960° C., from which it can be clearly seen that γ grains are fine and uniform in size at 950° C., the normal upper limit of carburization.

The comparative samples 12 that had an Al content below the lower limit specified by the present invention exhibited inferior grain coarsening characteristics. Comparative examples 13 and 14, which had an Al content exceeding the limit specified by the present invention, exhibited inferior grain coarsening characteristics. This is because the existence of coarse AlN impeded fine. dispersion of AlN and Nb(CN). Comparative example 15, which had a Nb content lower than that specified by this invention, exhibited inferior grain coarsening characteristics. When cold forging was done following spheroidization annealing, as in the present invention, and there is no fine Nb(CN), and fine AlN on its own cannot suppress the grain coarsening. In comparative examples 16 and 17 in which the Nb content was below the amount specified by the present invention, the grain coarsening characteristics were inferior. In comparative example 18 in which the N content was below the amount specified by this invention, the grain coarsening characteristics were inferior as there was an insufficient amount of nitrides. In comparative example 19 in which the N content was higher than the level specified by the present invention, there were coarse precipitations, again showing inferior grain coarsening characteristics. The reason why some poor grain coarsening characteristics were exhibited by the inventive steel and example steels in JP-A-58-45354 is considered to be the high N content of 0.21% or more. Inferior grain coarsening characteristics were exhibited by comparative examples 20 and 21, in which the Ti content and oxygen content were below the level specified by the present invention. In the case of comparative example 22 the composition was within the range specified by this invention, but at 1.50° C./s the cooling rate after hot rolling was high so the Nb(CN) precipitation amount following the hot rolling was below the inventive range, resulting in a low grain coarsening temperature. The composition of comparative example 23 also was within the range specified by the present invention, but at 1080° C., the hot rolling temperature was low, resulting in insufficient solution treatment of AlN, and therefore an AlN precipitation amount following hot rolling that was above the specified amount, and hence a low grain coarsening temperature.

Example 2

The square rolled bars measuring 162 mm a side prepared in Example 1 were hot rolled to form round bars having a diameter of 23 to 25 mm. The hot rolling was performed at a temperature of 1150° C. to 1280° C., with a finishing temperature of 840° C. to 1000° C. After rolling, the steel was cooled from 800° C. to 500° C. at a rate of 0.2 to 1.5° C./s. To ascertain the dispersion state of the Nb(CN) in the hot rolled bars, the extraction replica method was used to obtain a sample of precipitates in the steel matrix, and a transmission electron microscope was used to examine the sample at a magnification of 30,000× and count the number of Nb(CN) particles having a diameter of not more than 0.1 μm in about 20 fields of view. The count was converted to obtain the number per 100 $\mu m^2$. Also, the structure of the rolled bars was examined to obtain the bainite structure fraction and ferrite grain size number.

The hot rolled bar steel was tempered and the grain coarsening temperature obtained by the same method used in Example 1. The results are listed in Table 3. The samples of the second inventive steel exhibited a grain coarsening temperature of not less than 970° C. and a γ grain size number of not less than 8.7 during the carburization at 950° C. Also, the samples of the third inventive steel exhibited a grain coarsening temperature of not less than 990° C. and a γ grain size number of not less than 9.5 during the carburization at 950° C. The samples of the fourth inventive steel exhibited a grain coarsening temperature of not less than 1010° C. and a γ grain size number of not less than 10.0 during the carburization at 950° C. As these results show, each of the inventive steels subjected to carburization at 950° C., which is higher than the temperature normally used, were fine grained.

On the other hand, comparative example 34, which used a high cooling rate of 1.5° C./s following the hot rolling, and had an Nb(CN) precipitation and particle count, after hot rolling below those specified by the invention, and comparative example 43, which also used a high cooling rate of 1.5° C./s following the hot rolling, and had a bainite structure fraction following hot rolling that was above the fraction specified by the invention, each exhibited a low grain coarsening temperature. A low-grain coarsening temperature was also exhibited by comparative example 50, which used a low hot rolling finishing temperature of 840° C. and had a ferrite grain size number below that specified by the invention.

Example 3

The square rolled bars measuring 162 mm a side prepared in Example 1 were hot rolled to produce round bars having a diameter of 25 mm, under various hot rolling conditions. After spheroidization annealing, the grain coarsening temperature of the hot rolled bars was obtained by the same method used in Example 1. The results are listed in Table 4. The inventive steels exhibited a grain coarsening temperature of not less than 970° C. and a γ grain size number of not less than 8.8 during carburization at 950° C. As these results show, each of the inventive steels subjected to carburization at 950° C., which, is higher than the temperature normally used, had fine grains .

In contrast, in comparative example 53, which used a lower hot rolling temperature than specified by the present invention, and had a higher AlN precipitation, amount than that specified by the present invention, coarse grains were produced even at 910° C.

Example 4

The square rolled bars measuring 162 mm a side prepared in Example 1 were hot rolled to produce round bars having a diameter of 25 mm, under various hot rolling conditions. After spheroidization annealing, the grain coarsening temperature of the hot rolled bars was obtained by the same method used in Example 1. The results are listed in Table 5. The sixth inventive steels exhibited a grain coarsening temperature of not less than 990° C. and a γ grain size number of not less than 9.4 during carburization at 950° C. Also, the seventh inventive steels exhibited a grain coarsening temperature of not less than 1010° C. and a γ grain size number of not less than 10.0 during carburization at 950° C. As these results show, each of the inventive steels subjected to carburization at 950° C., which is higher than the temperature normally used, had fine grains.

In contrast, in comparative example 73, which used a lower hot rolling finishing temperature than specified by the present invention, and after hot rolling had a higher ferrite grain size number than that specified by the invention, coarse grains were produced at 950° C. In comparative example 74, which used a higher cooling rate than that specified by the present invention, the bainite structure fraction was higher than that specified by the invention, and coarse grains were produced at 950° C.

Example 5

Steel melts having the compositions listed in Table 6 were prepared in a converter and continuously cast and, if necessary, rolled into ingots to form square rolled bars measuring 162 mm a side. These were then hot rolled to produce round bars having a diameter of 80 mm. These bars were then hot forged to form blanks 65 mm in diameter. A hot forging temperature of 1100° C. to 1290° C. was used. After the hot forging, the steels were cooled from 800° C. to 500° C. at a rate of 0.2 to 1.3° C./s. The amounts of AlN precipitation and Nb(CN) precipitation in the hot forged blanks were obtained by chemical analysis.

The blanks thus produced were normalized by being heated for one hour at 900° C. and air cooled. This was followed by a carburization simulation of five hours at 1050° C. and water cooling. Following this, a cut surface of the material was polished and etched to examine the prior austenite grain size. The prior austenite grain size was measured based On the method of JIS G 0551. After the blanks had been normalized, cylindrical rolling fatigue test specimens having a diameter of 12.2 mm were prepared and subjected to carburization hardening. For the carburization, one of the following three conditions was used. Carburization condition II is carbonitriding.

I. 1000° C. for 12 hours, carbon potential of 1.15%.

II. 1000° C. for 12 hours, carbon potential of 1.15%, followed by nitriding at 870° C. Nitrogen concentration: approximately 0.4%.

III. 1050° C. for one hour, carbon potential of 1.2%.

In the case of all these conditions, the temperature of the hardening oil was 130° C., and tempering was carried out using a temperature of 180° C. for two hours.

The hardness, retained austenite amount and γ grain size number of the carburization hardened materials were investigated. A point contact type rolling fatigue tester (maximum Hertzian contact stress of 5884 MPa) was used to evaluate the rolling fatigue properties. $L_{10}$ life (defined as the number of stress cycles to fatigue failure at a cumulative failure probability of 10% obtained by plotting the test results oh Weibull probability paper) was used as a measure of the fatigue life.

The results are listed in Table 7. The rolling fatigue life value of each material is indicated as the $L_{10}$ life relative to the $L_{10}$ of comparative example 98 (steel level u), which is assumed to be 1.

As revealed by Table 7, the γ grains of the inventive materials are fine particles of size No. 8 or more, meaning a very good rolling fatigue life that is over five times that of the comparative examples. The rolling fatigue life of the inventive material subjected to carbonitriding using the carburization condition II was particularly good. This is due to the high retained γ amount, and the extensive precipitation of Nb(CN) in the carburization layer during the carbonitriding.

On the other hand, in comparative example 96, in which the Al content was below the level specified in the present invention,and in comparative example 97, in which the Al content was above the level specified in the present invention, coarse grains were produced. Also, in comparative example 98, in which the Nb content was below the level specified in the present invention, and in comparative example 99, in which the Nb content was above the level specified in the present invention, coarse grains were produced. In comparative example 100, an N content lower than specified in the present invention resulted in coarse grains because of a lack of sufficient nitrides. Coarse grains were also produced in comparative example 101, in which the N content was lower than specified in the present invention. In comparative examples 102 and 103, which had a Ti content and an oxygen content above those specified in the present invention, the grains were coarser than those of the inventive material, and the rolling fatigue properties inadequate. Although the composition of comparative example 104 was within the limits specified by the present invention, the cooling rate after the hot forging was faster, 1.3° C./s, and the Nb(CN) precipitation amount after hot forging was below that specified by the invention, resulting in the production of coarse grains. Although the composition of comparative example 105 also was within the limits specified by the present invention, the temperature for the hot forging was lower, 1100° C., so the AlN solution treatment was insufficient and the amount of AlN precipitation after the hot forging was over the limit specified by the invention, giving rise to coarse grains.

Next, some of the blanks formed by hot forging were used as test specimens. After carburization hardening under the above conditions, they were again subjected to heating and hardening, at 900° C. for one hour. The results are listed in Table 8. This shows that this made the γ grains of the steels of the present invention even finer, and also further improved. the rolling fatigue life. The rolling fatigue life of the inventive material subjected to carbonitriding using the carburization condition II showed a particularly good improvement in rolling fatigue life. This was the result of the increase in the amount finely dispersed Nb(CN) brought about by the use of two hardening processes.

Example 6

The round bars having a diameter of 80 mm produced in Example 5 were hot forged to form blanks 30 to 45 mm in diameter. A hot forging heating temperature of 1200° C. to 1300° C. was used, and after the hot forging, the steels were cooled from 800° C. to 500° C. at a rate of 0.4 to 1.5° C./. To ascertain the dispersion state of the Nb(CN) in the hot forged bars, the extraction replica method was used to obtain a sample of precipitates in the steel matrix, and a transmission electron microscope was used to examine the sample at a magnification of 30,000× and count the number of Nb(CN) particles having a diameter of not more than 0.1 μm in about 20 fields of view. The count was then converted to obtain the count per 100 μnm. As in Example 5, carburization was carried out and the rolling fatigue properties obtained. The results are listed in Table 9. In each case, the inventive steels exhibited fine γ grains and excellent rolling fatigue properties. In contrast, in comparative example 125, which used a high cooling rate of 1.5° C./s, the amount of Nb(CN) precipitates following the hot forging, and the Nb(CN) particle count, were below the level specified by the present invention, giving rise to coarse grains and inadequate rolling fatigue properties.

TABLE 1

(mass %)

| | Steel level | C | Si | Mn | S | Al | Nb | N | Cr | Mo | Ni | V | P | Ti | O |
|---|---|---|---|---|---|---|---|---|---|---|---|---|---|---|---|
| Inventive steel | A | 0.19 | 0.29 | 0.83 | 0.012 | 0.028 | 0.028 | 0.0184 | 1.07 | — | — | — | 0.016 | 0.0018 | 0.0014 |
| | B | 0.20 | 0.04 | 0.81 | 0.015 | 0.031 | 0.025 | 0.0174 | 1.05 | — | — | — | 0.014 | 0.0021 | 0.0009 |
| | C | 0.20 | 0.05 | 0.66 | 0.015 | 0.028 | 0.025 | 0.0173 | 1.53 | — | — | — | 0.015 | 0.0022 | 0.0018 |
| | D | 0.19 | 0.26 | 0.82 | 0.020 | 0.026 | 0.023 | 0.0146 | 1.04 | 0.18 | — | — | 0.017 | 0.0020 | 0.0016 |
| | E | 0.21 | 0.04 | 0.64 | 0.017 | 0.030 | 0.026 | 0.0162 | 0.99 | 0.16 | — | — | 0.013 | 0.0019 | 0.0014 |
| | F | 0.20 | 0.03 | 0.75 | 0.014 | 0.031 | 0.022 | 0.0173 | 0.84 | 0.74 | — | — | 0.009 | 0.0017 | 0.0016 |
| | G | 0.19 | 0.04 | 0.72 | 0.016 | 0.032 | 0.024 | 0.0168 | 0.83 | 0.76 | — | 0.12 | 0.012 | 0.0022 | 0.0017 |
| | H | 0.20 | 0.26 | 0.65 | 0.021 | 0.030 | 0.022 | 0.0159 | 0.55 | 0.21 | 1.78 | — | 0.013 | 0.0021 | 0.0018 |
| | J | 0.20 | 0.42 | 0.78 | 0.018 | 0.035 | 0.022 | 0.0164 | 0.98 | — | — | — | 0.016 | 0.0022 | 0.0017 |
| | K | 0.20 | 0.27 | 0.75 | 0.013 | 0.025 | 0.022 | 0.0101 | 1.02 | — | — | — | 0.015 | 0.0020 | 0.0015 |
| | L | 0.19 | 0.23 | 0.80 | 0.018 | 0.026 | 0.020 | 0.0089 | 0.98 | 0.21 | — | — | 0.018 | 0.0021 | 0.0019 |
| Comparative steel | M | 0.21 | 0.20 | 0.80 | 0.015 | 0.011 | 0.025 | 0.0170 | 1.00 | — | — | — | 0.015 | 0.0018 | 0.0013 |
| | N | 0.20 | 0.06 | 0.81 | 0.016 | 0.049 | 0.022 | 0.0181 | 0.98 | — | — | — | 0.017 | 0.0017 | 0.0009 |
| | O | 0.20 | 0.05 | 0.81 | 0.015 | 0.052 | 0.026 | 0.0163 | 1.06 | 0.16 | — | — | 0.013 | 0.0019 | 0.0016 |
| | P | 0.19 | 0.05 | 0.76 | 0.016 | 0.026 | 0.002 | 0.0167 | 1.12 | — | — | — | 0.015 | 0.0022 | 0.0018 |
| | Q | 0.20 | 0.24 | 0.79 | 0.019 | 0.031 | 0.048 | 0.0142 | 1.06 | — | — | — | 0.019 | 0.0017 | 0.0017 |
| | R | 0.20 | 0.23 | 0.78 | 0.021 | 0.035 | 0.053 | 0.0148 | 0.97 | 0.17 | — | — | 0.016 | 0.0018 | 0.0019 |
| | S | 0.20 | 0.18 | 0.83 | 0.017 | 0.029 | 0.027 | 0.0052 | 1.05 | — | — | — | 0.016 | 0.0018 | 0.0014 |
| | T | 0.21 | 0.06 | 0.81 | 0.014 | 0.030 | 0.028 | 0.0224 | 0.99 | — | — | — | 0.014 | 0.0021 | 0.0009 |
| | U | 0.20 | 0.05 | 0.84 | 0.016 | 0.028 | 0.020 | 0.0180 | 1.02 | — | — | — | 0.016 | 0.0124 | 0.0018 |
| | V | 0.19 | 0.24 | 0.79 | 0.020 | 0.026 | 0.022 | 0.0151 | 0.98 | — | — | — | 0.016 | 0.0022 | 0.0029 |
| Inventive steel | W | 0.20 | 0.25 | 0.78 | 0.015 | 0.032 | 0.024 | 0.0175 | 1.00 | — | — | — | 0.014 | 0.0019 | 0.0017 |
| | X | 0.19 | 0.24 | 0.83 | 0.017 | 0.030 | 0.026 | 0.0174 | 1.02 | 0.18 | — | — | 0.016 | 0.0020 | 0.0018 |
| | Y | 0.21 | 0.22 | 0.75 | 0.015 | 0.027 | 0.025 | 0.0161 | 0.97 | — | — | — | 0.017 | 0.0021 | 0.0020 |
| | Z | 0.19 | 0.24 | 0.79 | 0.020 | 0.031 | 0.023 | 0.0164 | 1.01 | 0.19 | — | — | 0.018 | 0.0018 | 0.0012 |

TABLE 2

(Example 1)

| | Steel No. | Steel level | Nb(CN) precipitation after rolling % | AlN precipitation after rolling % | Hardness after rolling HV | Carburization simulation result: Grain coarsening temperature ° C. | Carburization simulation result: γ-grain size after carburization at 950° C. |
|---|---|---|---|---|---|---|---|
| Inventive range | | | ≧0.005 | ≦0.005 | | | |
| First inventive steel | 1 | A | 0.017 | 0.0015 | 183 | 970 | 8.8 |
| | 2 | B | 0.015 | <0.0015 | 177 | 960 | 8.7 |
| | 3 | C | 0.015 | 0.0022 | 163 | 980 | 9.2 |
| | 4 | D | 0.014 | 0.0030 | 228 | 980 | 9.3 |
| | 5 | E | 0.016 | 0.0025 | 179 | 960 | 8.4 |
| | 6 | F | 0.014 | 0.0015 | 245 | 970 | 8.2 |
| | 7 | G | 0.014 | <0.0015 | 259 | 970 | 8.8 |
| | 8 | H | 0.013 | 0.0023 | 262 | 990 | 8.6 |
| | 9 | J | 0.014 | 0.0021 | 186 | 970 | 8.2 |
| | 10 | K | 0.014 | 0.0030 | 182 | 990 | 9.3 |
| | 11 | L | 0.013 | 0.0015 | 231 | 990 | 9.5 |
| Comparative steel | 12 | M | 0.016 | <0.0015 | 184 | 930 | 4.2 |
| | 13 | N | 0.013 | 0.0039 | 175 | 910 | 2.0 |
| | 14 | O | 0.015 | 0.0042 | 237 | 910 | 2.5 |
| | 15 | P | 0.001 | 0.0023 | 182 | 930 | 3.5 |
| | 16 | Q | 0.030 | 0.0035 | 179 | 910 | 2.6 |
| | 17 | R | 0.032 | 0.0030 | 222 | 910 | 2.7 |
| | 18 | S | 0.016 | 0.0015 | 182 | 910 | 2.5 |
| | 19 | T | 0.017 | 0.0023 | 215 | 950 | 4.5 |
| | 20 | U | 0.018 | 0.0037 | 172 | 950 | 4.2 |
| | 21 | V | 0.017 | 0.0032 | 182 | 950 | 4.0 |
| | 22 | W | 0.002 | 0.0030 | 185 | 930 | 3.5 |
| | 23 | X | 0.032 | 0.0241 | 221 | 910 | 2.0 |

TABLE 3

(Example 2)

| | Steel No. | Steel level | Nb(CN) precipitation after rolling % | AlN precipitation after rolling % | Nb(CN) particles per 100 $\mu m^2$ after rolling | Bainite fraction after rolling % | Ferrite grain size No. after rolling | Hardness after rolling HV | Carburization simulation result: Grain coarsening temperature ° C. | Carburization simulation result: γ-grain size after carburization at 950° C. |
|---|---|---|---|---|---|---|---|---|---|---|
| Inventive range | | | ≧0.005 | ≦0.005 | ≧20 | ≦30 | 8–11 | | | |
| Second inventive steel | 31 | A | 0.017 | 0.0015 | 94 | — | — | 183 | 980 | 9.2 |
| | 32 | D | 0.014 | 0.0030 | 162 | — | — | 228 | 990 | 9.6 |
| | 33 | H | 0.013 | 0.0023 | 62 | — | — | 262 | 970 | 8.7 |
| Comparative steel | 34 | W | <0.003 | 0.0015 | 12 | — | — | 179 | 910 | 3.5 |
| Third inventive steel | 35 | B | 0.015 | <0.0015 | 284 | 7 | — | 176 | 1010 | 10.3 |
| | 36 | B | 0.017 | 0.0015 | 321 | 11 | — | 174 | 1010 | 10.4 |
| | 37 | L | 0.013 | 0.0020 | 101 | 19 | — | 228 | 990 | 9.5 |
| | 38 | L | 0.012 | 0.0030 | 129 | 16 | — | 231 | 990 | 10.1 |
| | 39 | H | 0.013 | 0.0023 | 372 | 17 | — | 258 | >1010 | 11.2 |
| | 40 | H | 0.014 | 0.0020 | — | 17 | — | 260 | 990 | 9.6 |
| | 41 | K | 0.016 | 0.0015 | — | 14 | — | 183 | 990 | 9.5 |
| | 42 | K | 0.015 | 0.0030 | 172 | 12 | — | 186 | 1010 | 10.5 |
| Comparative steel | 43 | H | 0.013 | 0.0023 | 97 | 85 | — | 282 | <910 | 1.0 |
| Fourth inventive steel | 44 | Y | 0.017 | 0.0015 | 242 | 14 | 9.5 | 185 | 1010 | 10.1 |
| | 45 | Y | 0.014 | 0.0030 | 260 | — | 10.1 | 184 | 1010 | 10.4 |
| | 46 | Y | 0.017 | 0.0015 | 460 | 14 | 9.5 | 183 | >1010 | 11.1 |
| | 47 | Y | 0.014 | 0.0030 | 337 | — | 9.2 | 179 | >1010 | 10.8 |
| | 48 | Z | 0.017 | 0.0025 | — | 16 | 8.8 | 226 | >1010 | 10.0 |
| | 49 | Z | 0.015 | 0.0025 | — | — | 9.9 | 229 | >1010 | 10.3 |
| Comparative steel | 50 | Z | 0.018 | 0.0023 | 80 | 21 | 12.0 | 228 | 930 | 3.4 |

—: Not measured

TABLE 4

(Example 3)

| | Steel No. | Steel level | Hot rolling condition Heating temperature* ° C. | Nb(CN) precipitation after rolling % | AlN precipitation after rolling % | Hardness after rolling HV | Carburization simulation result: Grain coarsening temperature ° C. | Carburization simulation result: γ-grain size after carburization at 950° C. |
|---|---|---|---|---|---|---|---|---|
| Inventive range | | | ≧1150 | ≧0.005 | ≦0.005 | | | |
| Fifth inventive steel | 51 | A | 1205 | 0.017 | 0.0025 | 183 | 970 | 8.8 |
| | 52 | D | 1230 | 0.014 | 0.0015 | 228 | 980 | 9.4 |
| Comparative steel | 53 | A | 1100 | 0.019 | 0.0287 | 187 | <910 | 1.2 |

*Held for 20 min.

TABLE 5

(Example 4)

| | Steel No. | Steel level | Hot rolling condition: Heating temperature* ° C. | Hot rolling condition: Finishing temperature ° C. | Hot rolling condition: Cooling rate ° C./sec | Nb(CN) precipitation after rolling % | AlN precipitation after rolling % | Nb(CN) particles per 100 $\mu m^2$ after rolling | Bainite fraction after rolling % | Ferrite grain size No. after rolling | Hardness after rolling HV | Carburization simulation result: Grain coarsening temperature ° C. | Carburization simulation result: γ-grain size after carburization at 950° C. |
|---|---|---|---|---|---|---|---|---|---|---|---|---|---|
| Inventive range | | | ≧1150 | 920–1000 | ≦1 | ≧0.005 | ≦0.005 | ≧20 | ≦30 | 8–11 | | | |
| Sixth inventive steel | 61 | W | 1225 | — | 0.50 | 0.021 | 0.0015 | 116 | — | — | 192 | 990 | 9.6 |
| | 62 | X | 1210 | — | 0.69 | 0.018 | 0.0030 | 155 | — | — | 223 | 1010 | 9.8 |
| | 63 | Y | 1235 | — | 0.56 | 0.017 | <0.0015 | — | 17 | — | 187 | 990 | 9.6 |
| | 64 | X | 1235 | — | 0.55 | 0.018 | 0.0016 | — | 18 | — | 221 | 990 | 9.4 |
| | 65 | X | 1210 | — | 0.61 | 0.015 | 0.0023 | 172 | 14 | — | 223 | 1010 | 10.2 |
| | 66 | Y | 1225 | — | 0.63 | 0.017 | 0.0020 | 72 | 10 | — | 191 | 990 | 9.7 |
| Seventh inventive steel | 67 | A | 1230 | 950 | — | 0.016 | 0.0020 | — | — | 9.4 | 187 | 1010 | 10.0 |
| | 68 | D | 1215 | 955 | — | 0.015 | 0.0024 | — | — | 9.6 | 224 | 1010 | 10.6 |
| | 69 | X | 1225 | 960 | 0.54 | 0.017 | 0.0015 | 183 | — | 9.5 | 223 | >1010 | 10.8 |
| | 70 | Y | 1215 | 950 | 0.62 | 0.015 | <0.0015 | 160 | — | 9.6 | 187 | 1010 | 10.2 |
| | 71 | X | 1240 | 955 | 0.69 | 0.017 | 0.0020 | 246 | 12 | 9.2 | 225 | >1010 | 10.8 |
| | 72 | H | 1235 | 960 | 0.50 | 0.016 | <0.0015 | 324 | 20 | 9.4 | 258 | >1010 | 11.3 |
| Comparative steel | 73 | X | 1210 | 840 | — | 0.016 | 0.0017 | 125 | 15 | 11.6 | 231 | 950 | 4.0 |
| | 74 | Y | 1235 | 945 | 1.35 | 0.007 | 0.0025 | 121 | 82 | 10.6 | 185 | 950 | 3.4 |

*Held for 20 min.
—: Not measured.

TABLE 6

(mass %)

| | Steel level | C | Si | Mn | S | Al | Nb | N | Cr | Mo | Ni | V | P | Ti | O |
|---|---|---|---|---|---|---|---|---|---|---|---|---|---|---|---|
| Inventive steel | a | 0.20 | 0.22 | 0.83 | 0.006 | 0.029 | 0.027 | 0.0175 | 1.05 | — | — | — | 0.014 | 0.0009 | 0.0009 |
| | b | 0.19 | 0.24 | 0.81 | 0.005 | 0.030 | 0.026 | 0.0186 | 1.16 | 0.17 | — | — | 0.016 | 0.0012 | 0.0008 |
| | c | 0.26 | 0.23 | 0.76 | 0.005 | 0.031 | 0.030 | 0.0183 | 1.18 | 0.29 | — | — | 0.011 | 0.0010 | 0.0008 |
| | d | 0.34 | 0.20 | 0.82 | 0.007 | 0.026 | 0.024 | 0.0144 | 1.06 | 0.18 | — | — | 0.014 | 0.0014 | 0.0007 |
| | e | 0.21 | 0.42 | 0.74 | 0.006 | 0.030 | 0.027 | 0.0161 | 1.02 | 0.17 | — | — | 0.016 | 0.0014 | 0.0009 |
| | f | 0.20 | 0.58 | 0.82 | 0.006 | 0.030 | 0.023 | 0.0175 | 1.03 | 0.18 | — | — | 0.011 | 0.0015 | 0.0009 |
| | g | 0.19 | 1.01 | 0.69 | 0.005 | 0.032 | 0.022 | 0.0162 | 1.02 | 0.25 | — | — | 0.012 | 0.0010 | 0.0007 |
| | h | 0.24 | 0.98 | 0.42 | 0.007 | 0.031 | 0.024 | 0.0157 | 1.44 | 0.25 | — | — | 0.009 | 0.0009 | 0.0008 |
| | i | 0.25 | 0.05 | 0.91 | 0.006 | 0.028 | 0.024 | 0.0160 | 1.21 | 0.41 | — | — | 0.014 | 0.0016 | 0.0007 |
| | j | 0.35 | 0.62 | 0.44 | 0.005 | 0.034 | 0.025 | 0.0162 | 1.43 | 0.24 | — | — | 0.013 | 0.0010 | 0.0009 |
| | k | 0.22 | 0.93 | 0.62 | 0.004 | 0.025 | 0.024 | 0.0104 | 1.44 | 0.24 | — | — | 0.015 | 0.0014 | 0.0008 |
| | l | 0.23 | 0.23 | 0.80 | 0.005 | 0.027 | 0.024 | 0.0090 | 1.45 | — | — | — | 0.016 | 0.0013 | 0.0009 |
| | m | 0.21 | 0.20 | 0.80 | 0.007 | 0.031 | 0.027 | 0.0168 | 1.04 | 0.52 | — | — | 0.015 | 0.0016 | 0.0008 |
| | n | 0.20 | 0.06 | 0.81 | 0.004 | 0.029 | 0.025 | 0.0176 | 1.43 | 0.49 | — | — | 0.014 | 0.0012 | 0.0009 |
| | o | 0.20 | 0.41 | 0.78 | 0.007 | 0.031 | 0.027 | 0.0174 | 1.05 | 0.43 | — | — | 0.016 | 0.0011 | 0.0007 |

TABLE 6-continued (mass %)

| | Steel level | C | Si | Mn | S | Al | Nb | N | Cr | Mo | Ni | V | P | Ti | O |
|---|---|---|---|---|---|---|---|---|---|---|---|---|---|---|---|
| | p | 0.35 | 0.42 | 0.67 | 0.005 | 0.030 | 0.028 | 0.0171 | 1.45 | 0.18 | — | — | 0.014 | 0.0016 | 0.0008 |
| | q | 0.21 | 0.22 | 0.75 | 0.006 | 0.032 | 0.027 | 0.0164 | 1.05 | 0.17 | 1.82 | — | 0.014 | 0.0015 | 0 0007 |
| | r | 0.19 | 0.24 | 0.79 | 0.007 | 0.028 | 0.026 | 0.0159 | 1.01 | 0.19 | — | 0.13 | 0.015 | 0.0016 | 0.0007 |
| Compara- | s | 0.21 | 0.24 | 0.78 | 0.006 | 0.010 | 0.028 | 0.0165 | 1.05 | 0.17 | — | — | 0.015 | 0.0015 | 0.0007 |
| tive | t | 0.20 | 0.22 | 0.81 | 0.005 | 0.056 | 0.031 | 0.0164 | 1.12 | 0.20 | — | — | 0.014 | 0.0017 | 0.0008 |
| steel | u | 0.21 | 0.21 | 0.76 | 0.007 | 0.031 | 0.001 | 0.0147 | 1.06 | 0.17 | — | — | 0.018 | 0.0015 | 0.0009 |
| | v | 0.20 | 0.25 | 0.82 | 0.008 | 0.034 | 0.055 | 0.0143 | 1.03 | 0.16 | — | — | 0.017 | 0.0016 | 0.0008 |
| | w | 0.20 | 0.23 | 0.76 | 0.006 | 0.030 | 0.029 | 0.0051 | 1.05 | 0.20 | — | — | 0.015 | 0.0014 | 0.0007 |
| | x | 0.19 | 0.17 | 0.83 | 0.006 | 0.029 | 0.030 | 0.0227 | 1.03 | 0.17 | — | — | 0.015 | 0.0015 | 0.0009 |
| | y | 0.21 | 0.24 | 0.81 | 0.005 | 0.028 | 0.031 | 0.0181 | 1.02 | 0.16 | — | — | 0.017 | 0.0116 | 0.0008 |
| | z | 0.20 | 0.21 | 0.83 | 0.007 | 0.026 | 0.025 | 0.0153 | 0.98 | 0.18 | — | — | 0.014 | 0.0016 | 0.0028 |

TABLE 7

(Example 5)

| | Steel No. | Steel level | Nb(CN) precipitation of forged product % | AlN precipitation of forged product % | γ-grain size after carburization simulation at 1050° C. for 5 hrs | Properties of high temperature-carburized product: Carburization condition | Hardness of outermost layer | Retained γ of outermost layer % | γ-grain size | Rolling fatigue life (relative value) * |
|---|---|---|---|---|---|---|---|---|---|---|
| Inventive range | | | ≧0.005 | ≦0.005 | | | | | | |
| Eighth | 81 | a | 0.016 | 0.0017 | 8.6 | I | 784 | 19 | 8.2 | 5.5 |
| inventive | 82 | b | 0.016 | <0.0015 | 9.0 | I | 792 | 18 | 8.5 | 6.3 |
| steel | 83 | c | 0.014 | 0.0026 | 8.9 | II | 744 | 37 | 8.4 | 8.8 |
| | 84 | d | 0.015 | 0.0025 | 9.1 | II | 746 | 36 | 8.7 | 9.1 |
| | 85 | e | 0.014 | 0.0021 | 8.4 | II | 751 | 38 | 8.0 | 12.7 |
| | 86 | f | 0.013 | 0.0030 | 8.4 | II | 748 | 38 | 8.0 | 13.2 |
| | 87 | g | 0.013 | <0.0015 | 8.6 | II | 750 | 36 | 8.3 | 15.4 |
| | 88 | h | 0.014 | 0.0017 | 8.8 | II | 752 | 37 | 8.4 | 15.3 |
| | 89 | i | 0.015 | 0.0022 | 9.1 | III | 784 | 16 | 9.4 | 5.9 |
| | 90 | j | 0.015 | 0.0024 | 8.4 | III | 791 | 17 | 8.8 | 6.1 |
| | 91 | k | 0.013 | 0.0028 | 9.0 | III | 780 | 18 | 8.7 | 5.3 |
| | 92 | n | 0.016 | 0.0016 | 9.3 | I | 748 | 19 | 9.0 | 6.4 |
| | 93 | p | 0.015 | <0.0015 | 9.1 | I | 784 | 18 | 8.8 | 6.9 |
| | 94 | q | 0.014 | 0.0031 | 9.2 | II | 736 | 35 | 8.9 | 9.5 |
| | 95 | r | 0.014 | 0.0038 | 9.2 | II | 741 | 35 | 9.0 | 8.6 |
| Comparative | 96 | s | 0.016 | <0.0015 | 1.3 | I | 779 | 16 | 1.1 | 0.5 |
| steel | 97 | t | 0.014 | 0.0047 | 2.5 | I | 781 | 17 | 2.1 | 0.7 |
| | 98 | u | 0.001 | 0.0024 | 4.3 | I | 791 | 17 | 3.8 | 1.0 |
| | 99 | v | 0.031 | 0.0030 | 4.5 | I | 787 | 16 | 3.9 | 1.2 |
| | 100 | w | 0.016 | <0.0015 | 3.2 | I | 771 | 18 | 2.5 | 0.8 |
| | 101 | x | 0.031 | 0.0045 | 4.6 | I | 769 | 16 | 3.4 | 1.3 |
| | 102 | y | 0.016 | 0.0022 | 8.5 | I | 784 | 18 | 6.2 | 0.6 |
| | 103 | z | 0.027 | 0.0025 | 8.4 | I | 782 | 17 | 7.3 | 0.7 |
| | 104 | a | 0.003 | <0.0015 | 4.9 | I | 779 | 18 | 4.6 | 1.7 |
| | 105 | b | 0.029 | 0.0250 | 2.4 | I | 783 | 17 | 1.8 | 0.5 |

* Relative value, taking the $L_{10}$ life of comparative steel 98 (steel level u) as 1.

TABLE 8

(Example 5)

| | Steel No. | Steel level | Nb(CN) precipitation of forged product % | AlN precipitation of forged product % | γ-grain size after carburization simulation at 1050° C. for 5 hrs | Properties of high temperature-carburized product: Carburization condition | Hardness of outermost layer | Retained γ of outermost layer % | γ-grain size | Rolling fatigue life (relative value) * |
|---|---|---|---|---|---|---|---|---|---|---|
| Inventive range | | | ≧0.005 | ≦0.005 | | | | | | |
| Eighth inventive steel | 111 | b | 0.0016 | <0.0015 | 9.0 | I + Quench-hardened by reheating** | 889 | 15 | 10.0 | 10.5 |
| | 112 | c | 0.014 | 0.0026 | 8.9 | II + Quench-hardened by reheating | 851 | 35 | 9.6 | 15.4 |
| | 113 | d | 0.015 | 0.0025 | 9.1 | II + Quench-hardened by reheating | 862 | 34 | 10.4 | 16.2 |
| | 114 | h | 0.014 | 0.0017 | 8.8 | II + Quench-hardened by reheating | 863 | 34 | 9.8 | 21.1 |
| | 115 | k | 0.013 | 0.0028 | 9.0 | III + Quench-hardened by reheating | 869 | 15 | 9.7 | 9.2 |

* Relative value taking the $L_{10}$ life of comparative steel 98 (steel level u) of Table 7 as 1.
** Quench-hardened after heating at 900° C. for 1 hr.

TABLE 9

(Example 6)

| | Steel No. | Steel level | Nb(CN) precipitation of forged product % | AlN precipitation of forged product % | Nb(CN) particles per 100 $\mu m^2$ of forged product | γ-grain size after carburization simulation at 1050° C. for 5 hrs | Properties of high temperature-carburized product: Carburization condition | Hardness of outermost layer | Retained γ of outermost layer % | γ-grain size | Rolling fatigue life (relative value) * |
|---|---|---|---|---|---|---|---|---|---|---|---|
| Inventive range | | | ≧0.005 | ≦0.005 | ≧20 | | | | | | |
| Ninth inventive steel | 121 | b | 0.012 | 0.0017 | 121 | 8.5 | I | 779 | 16 | 8.2 | 6.0 |
| | 122 | l | 0.011 | 0.0016 | 144 | 8.7 | II | 745 | 37 | 8.4 | 8.5 |
| | 123 | n | 0.012 | 0.0020 | 87 | 8.3 | II | 737 | 35 | 8.0 | 10.4 |
| | 124 | o | 0.012 | 0.0020 | 82 | 8.4 | II | 742 | 36 | 8.2 | 12.9 |
| Comparative steel | 125 | n | <0.003 | <0.0015 | 13 | 4.3 | I | 781 | 15 | 3.7 | 1.0 |

—: Not measured
* Relative value taking the $L_{10}$ life of comparative steel 98 (steel level u) of Table 7 as 1.

Industrial Applicability

By using the case hardening steel having good grain coarsening properties during carburization, and the method for producing the steel, according to the present. invention, grain coarsening during carburization can be suppressed, even of parts produced by cold forging. A result is that the degradation of dimensional precision caused by hardening strain is far less than in the prior art. This means that parts can be produced by cold forging, which conventionally has been difficult owing to the problem of coarse grains, and it also makes it possible to omit the normalizing step used after cold forging. Moreover, by using blank material for carburized parts having good grain coarsening prevention properties during carburization, grain coarsening can be prevented even when high-temperature carburization is used, thus making it possible to obtain adequate strength properties such as rolling fatigue characteristics. Thus, as described above, the present invention has a very strong industrial applicability.

What is claimed is:

1. A hot rolled case hardening steel in its final hot rolled condition, having good grain coarsening prevention properties during carburization, characterized in that said steel comprises, by mass, 0.1 to 0.4% C, 0.02 to 1.3% Si, 0.3 to 1.8% Mn, 0.001 to 0.15% S, 0.030 to 0.04% Al, 0.022 to 0.04% Nb, 0.006 to 0.0186% N, one, two or more selected from 0.4 to 1.8% Cr, 0.02 to 1.0% Mo, 0.1 to 3.5% Ni, 0.03 to 0.5% V, and in which P is limited to not more than 0.025%, Ti is limited to not more than 0.010%, and O is limited to not more than 0.0025%, with the balance being iron and unavoidable impurities, the steel having a Nb(CN) precipitation amount of not less than 0.005% and an AlN precipitation amount that is limited to not more than 0.005%.

2. The hot rolled steel according to claim 1, characterized in that the matrix of the steel contains not less than 20 particles/100 $\mu m^2$ of Nb(CN) of a particle diameter of not more than 0.1 $\mu m$.

3. The hot rolled steel according to claim 1, characterized in that the bainite structure fraction of the steel is limited to not more than 30%.

4. The hot rolled steel according to claim 1, characterized in that the steel has a ferrite grain size number of from 8 to 11.

5. A method of producing a case hardening steel having good grain coarsening prevention properties during carburization, characterized in that said method comprises preparing a steel comprising, by mass, 0.1 to 0.4% C, 0.02 to 1.3% Si, 0.3 to 1.8% Mn, 0.001 to 0.15% S, 0.030 to 0.04% Al, 0.022 to 0.04% Nb, 0.006 to 0.0186% N, one, two or more selected from 0.4 to 1.8% Cr, 0.02 to 1.0% Mo, 0.1 to 3.5% Ni, 0.03 to 0.5% V, and in which P is limited to not more than 0.025%, Ti is limited to not more than 0.010%, and O is limited to not more than 0.0025%, with the balance being iron and unavoidable impurities, heating the steel to a temperature of not less than 1150° C., maintaining the steel at that temperature for not less than 10 minutes, and hot rolling the steel to form wire or bar steel, the steel, following completion of hot rolling, having a Nb(CN) precipitation amount of not less than 0.005% and an AlN precipitation amount that is limited to not more than 0.005%.

6. The method according to claim 5, characterized in that following hot rolling, the steel is slowly cooled between 800 and 500° C. at a cooling rate of not more than 1° C./s to produce steel having a matrix containing not less than 20 particles/100 $\mu m^2$ of Nb(CN) of a particle diameter of not more than 0.1 $\mu m$, and bainite structure fraction that is limited to not more than 30%.

7. The method according to claim 5, characterized in that the steel is hot rolling finishing temperature of 920 to 1000° C. to have a ferrite grain size number of from 8 to 11.

8. A hot forged steel blank material for catburized parts in its final hot rolled condition, having good grain coarsening prevention properties during carburization, characterized in that said blank material comprises, by mass, 0.1 to 0.40% C, 0.02 to 1.3% Si, 0.3 to 1.8% Mn, 0.001 to 0.15% S, 0.030 to 0.04% Al, 0.022 to 0.04% Nb, 0.006 to 0.0186% N, one, two or more selected from 0.4 to 1.8% Cr, 0.02 to 1.0% Mo, 0.1 to 3.5% Ni, 0.03 to 0.5% V, and in which P is limited to not more than 0.025%, Ti is limited to not more than 0.010%, and O is limited to not more than 0.0025%, with the balance being iron and unavoidable impurities, the steel blank material having a Nb(CN) precipitation amount of not less than 0.005% and an AlN precipitation amount that is limited to not more than 0.005%.

9. The hot forged steel blank material according to claim 8, characterized in that the matrix of the steel contains not less than 20 particles/100 $\mu m^2$ of Nb(CN) of a particle diameter of not more than 0.1 $\mu m$.

* * * * *

UNITED STATES PATENT AND TRADEMARK OFFICE

CERTIFICATE OF CORRECTION

PATENT NO. : 6,660,105 B1
APPLICATION NO. : 09/269118
DATED : December 9, 2003
INVENTOR(S) : Tatsuro Ochi et al.

It is certified that error appears in the above-identified patent and that said Letters Patent is hereby corrected as shown below:

Column 26, line 17, change "is hot rolling finishing" to --is rolled at a hot rolled finishing--

Signed and Sealed this

Fourth Day of September, 2007

JON W. DUDAS
*Director of the United States Patent and Trademark Office*